US008855348B2

(12) United States Patent
Johnson

(10) Patent No.: US 8,855,348 B2
(45) Date of Patent: Oct. 7, 2014

(54) TELECOIL IN A DETACHABLE DIRECT AUDIO INPUT ACCESSORY

(75) Inventor: Andrew Joseph Johnson, Edina, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 13/568,637

(22) Filed: Aug. 7, 2012

(65) Prior Publication Data

US 2014/0044295 A1 Feb. 13, 2014

(51) Int. Cl.
*H04R 25/00* (2006.01)

(52) U.S. Cl.
USPC ..... 381/331; 381/312

(58) Field of Classification Search
CPC ..... H04R 2225/55
USPC ..... 381/312–331; 455/575.1; 379/52; 600/25
See application file for complete search history.

(56) References Cited

U.S. PATENT DOCUMENTS

| | | | | |
|---|---|---|---|---|
| 6,931,141 | B2 | 8/2005 | Moller | |
| 7,099,486 | B2 * | 8/2006 | Julstrom et al. | 381/331 |
| 7,548,211 | B2 | 6/2009 | Platz | |
| 7,777,681 | B2 | 8/2010 | Platz | |
| 7,783,067 | B1 * | 8/2010 | Frerking et al. | 381/315 |
| 8,027,638 | B2 * | 9/2011 | Sanguino et al. | 455/41.2 |
| 8,322,222 | B2 * | 12/2012 | Goldberg et al. | 73/647 |
| 2003/0031339 | A1 * | 2/2003 | Marshall et al. | 381/400 |
| 2006/0147069 | A1 * | 7/2006 | Svajda et al. | 381/316 |
| 2006/0245611 | A1 * | 11/2006 | Jorgensen et al. | 381/323 |
| 2008/0192969 | A1 * | 8/2008 | Welner | 381/314 |
| 2011/0194224 | A1 * | 8/2011 | Schoepke et al. | 361/170 |

OTHER PUBLICATIONS

Telecoil; Hearing Loss Association of North Carolina(HLA-NC); Retrieved from the internet : http://www.nchearingloss.org/telecoil.htm?fromncshhh.*

* cited by examiner

*Primary Examiner* — Brian Ensey
*Assistant Examiner* — Norman Yu
(74) *Attorney, Agent, or Firm* — Schwegman Lundberg & Woessner, P.A.

(57) ABSTRACT

Disclosed herein, among other things, are methods and apparatus for providing a hearing assistance device with a detachable telecoil. One aspect of the present subject matter includes an apparatus for communication with a hearing assistance device. In various embodiments, the apparatus includes a telecoil and a direct audio input (DAI) connector electrically connected to the telecoil. The DAI connector is configured to detachably attach to a DAI port of the hearing assistance device and to pass a signal from the telecoil to the hearing assistance device, in various embodiments.

20 Claims, 3 Drawing Sheets

TELECOIL IN A DETACHABLE DIRECT AUDIO INPUT ACCESSORY

FIELD OF THE INVENTION

The present subject matter relates generally to hearing assistance systems and more particularly to a hearing assistance device with a telecoil in a detachable direct audio input (DAI) accessory.

BACKGROUND

Hearing assistance devices, such as hearing aids, are used to assist patients suffering hearing loss by transmitting amplified sounds to ear canals. Some hearing aids include magnetic sensors that pick up sounds transmitted as magnetic signals. A telecoil, also referred to as a T-coil, T-switch, or a telephone switch, is such a magnetic sensor in a hearing aid that senses a magnetic signal representing a sound and, in response, generates an electrical signal representing the sound. The electrical signal causes a receiver (speaker) of the hearing aid to deliver the sound to an ear canal of the wearer. The magnetic signal may be generated from, for example, a hearing aid compatible telephone, an assistive listening system, or an assistive listening device (ALD). A hearing aid may turn off its microphone when its telecoil is turned on, such that the wearer hears the sound represented by the magnetic signal but not acoustic noises. The telecoil also eliminates acoustic feedback associated with using the microphone of the hearing aid to listen to a telephone.

In one example, a hearing aid is worn in and/or around a patient's ear. Patients generally prefer that their hearing aids are minimally visible or invisible. Because adding or improving functionality of the hearing aid may require larger and/or additional components, there is a need to provide such components without substantially increasing the overall size of the hearing aid.

SUMMARY

Disclosed herein, among other things, are methods and apparatus for providing a hearing assistance device with a detachable telecoil. One aspect of the present subject matter includes an apparatus for communication with a hearing assistance device. In various embodiments, the apparatus includes a telecoil and a direct audio input (DAI) connector electrically connected to the telecoil. The DAI connector is configured to detachably attach to a DAI port of the hearing assistance device and to pass a signal from the telecoil to the hearing assistance device, in various embodiments.

Another aspect of the present subject matter includes a method of operating a hearing assistance device. The method includes detecting a telecoil signal received at a DAI port of the hearing assistance device. The telecoil signal is received from a telecoil housed in an apparatus having a DAI connector configured to detachably attach to the DAI port of the hearing assistance device, in various embodiments.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
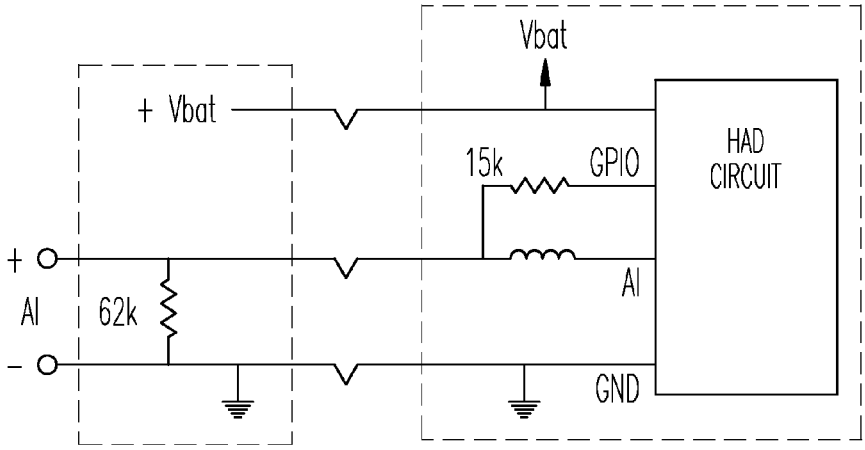
Fig.1 (Prior Art)
FIG. 1 is a circuit diagram showing a DAI detection scheme for a hearing assistance device.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Modern hearing assistance devices, such as hearing aids typically include a processor, such as a digital signal processor in communication with a microphone and receiver. Such designs are adapted to perform a great deal of processing on sounds received by the microphone. These designs can be highly programmable and may use inputs from remote devices, such as wired and wireless devices. One type of input found in hearing assistance devices is a direct audio input or DAI. A connector designed in the hearing assistance device, such as a hearing aid, provides direct audio signals to the hearing aid to play for the wearer.

Disclosed herein, among other things, are methods and apparatus for a hearing assistance device with a telecoil in a detachable direct audio input DAI accessory. One aspect of the present subject matter includes an apparatus for communication with a hearing assistance device. In various embodiments, the apparatus includes a telecoil and a DAI connector electrically connected to the telecoil. The DAI connector is configured to detachably attach to a DAI port of the hearing assistance device and to pass a signal from the telecoil to the hearing assistance device, in various embodiments.

The apparatus further includes an amplifier configured to amplify the signal, in various embodiments. According to various embodiments, the apparatus further includes telecoil electronics. At least portion of the DAI connector is configured to connect with a GPIO line of a processor of the hearing assistance device, in an embodiment. The telecoil is adapted for loop systems such as an ALD, for phone systems, or for both in various embodiments. In various embodiments, the telecoil includes multiple coils, including coils with different sizes and/or different orientations, in some embodiments. The telecoil includes surface mount device (SMD) coils, in an embodiment. The apparatus further includes a housing, and the telecoil is housed within the housing and the DAI connector is included along a surface of the housing in various embodiments. In one embodiment, the housing includes a boot. The boot is configured to fit over a portion of a housing of the hearing assistance device, in an embodiment. In various embodiments, the telecoil includes multiple coils of different sizes and orientations, with or without amplification, and with or without supporting electronics. In other embodiments, a 'Europlug' pass-through is included that mixes with the telecoil signal or overrides the telecoil signal.

Another aspect of the present subject matter includes a method of operating a hearing assistance device. The method includes detecting a telecoil signal received at a DAI port of the hearing assistance device. The telecoil signal is received from a telecoil housed in an apparatus having a DAI connector configured to detachably attach to the DAI port of the hearing assistance device, in various embodiments. The detected telecoil signal includes an active or passive signal, in various embodiments. According to various embodiments, detecting a telecoil signal includes sensing a low signal at a GPIO input to a processor of the hearing assistance device.

The present subject matter provides reduced size for hearing assistance devices, as the telecoil is moved to an external accessory device. An additional benefit is reduced cost, as telecoils can be expensive to design and incorporate into hearing devices, because of added shielding needed for proper operation. Also, telecoils in hearing devices can interfere with wireless components and pick up noises from surrounding circuitry.

One previous solution to this problem included not using telecoils at all, which is a disadvantage to those users that prefer to use a telecoil. Another previous solution was to place the telecoil in a wireless streaming device, but this greatly increases battery depletion and current drain of the hearing device while in telecoil mode. The present subject matter overcomes these disadvantages by using the telecoil in a detachable accessory device, so the hearing device itself is smaller and simpler. In addition, there is more space in the detachable accessory device allowing for a larger, less expensive coil in an easy to design environment farther from the noisy hearing assistance device electronics. The present subject matter relocates the telecoil out of a hearing assistance device into a hearing aid attachment specific to the style of the hearing assistance device, which passes the telecoil signal through the direct audio input (DAI) pins. This attachment has relatively small size, since a telecoil is fit inside, and allows the use of larger coils than would usually be considered in a particular hearing assistance device. This also permits less expensive surface mount coils to be used without having to align the hearing aid circuitry in a specific orientation so the telecoil is most sensitive.

FIG. 1 is a circuit diagram showing a DAI detection scheme for a hearing assistance device. A DAI connector is connected with a digital GPIO input to the hearing assistance device processor configured with a pull-up resistor (such as a 100 kΩ resistor in an embodiment), so the GPIO input is at a high voltage by default. The DAI connector includes a resistor tied between signal and ground which then pulls this GPIO low to alert the hearing assistance device circuit that a DAI audio accessory with an audio input (AI) is attached.

Figure 2:
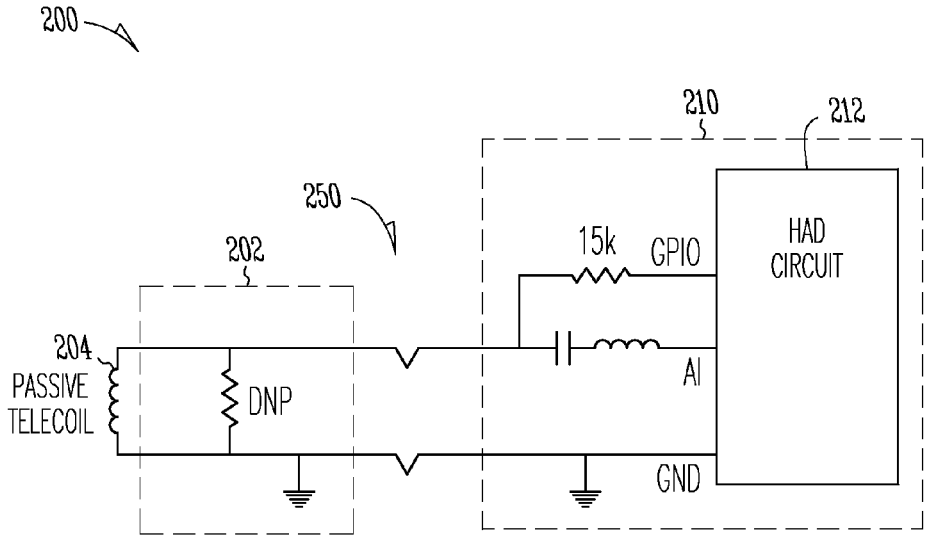
FIG. 2 is a circuit diagram showing a system including an apparatus having a passive telecoil for communication with a hearing assistance device, according to one embodiment of the present subject matter.

FIG. 2 is a circuit diagram showing a system 200 including an apparatus 202 having a passive telecoil 204 for communication with a hearing assistance device 210, according to one embodiment of the present subject matter. The apparatus 202 is detachably attached to the hearing assistance device 210 using a DAI connector 250. The hearing assistance device 210 includes a hearing assistance device circuit 212, which includes a processor having a GPIO input in various embodiments. In various embodiments, the DCR (direct current resistance) of the telecoil itself will pull the GPIO low. The apparatus can include two or more telecoils for a multi-axis configuration, in various embodiments.

Figure 3:
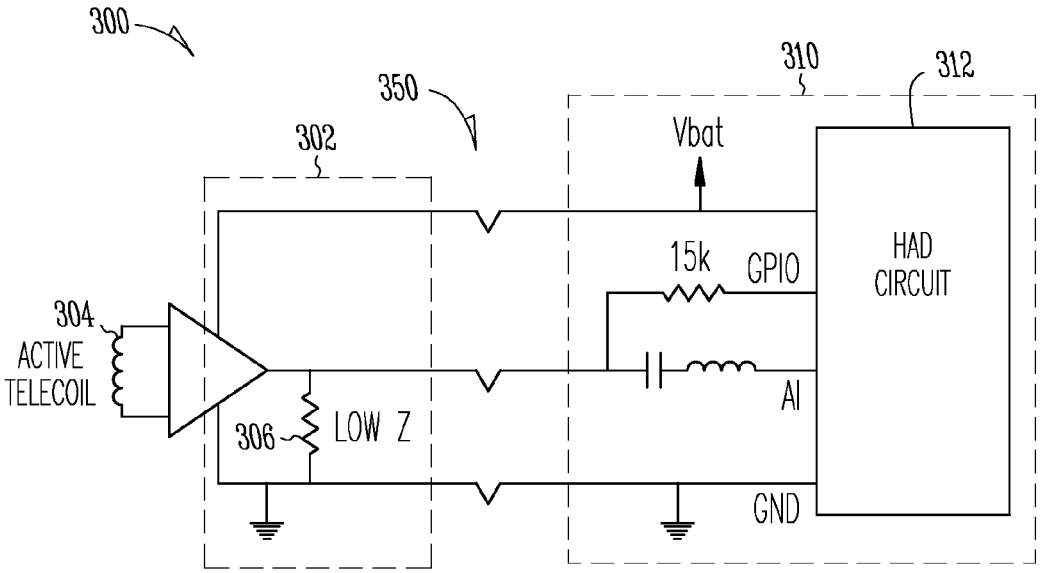
FIG. 3 is a circuit diagram showing a system including an apparatus having an active telecoil for communication with a hearing assistance device, according to one embodiment of the present subject matter.

FIG. 3 is a circuit diagram showing a system 300 including an apparatus 302 having an active telecoil 304 for communication with a hearing assistance device 310, according to one embodiment of the present subject matter. The apparatus 302 is detachably attached to the hearing assistance device 310 using a DAI connector 350. The hearing assistance device 310 includes a hearing assistance device circuit 312, which includes a processor having a GPIO input in various embodiments. The active telecoil has a low impedance connection 306 (or low value resistor) to pull the GPIO low, in an embodiment. The apparatus can include two or more telecoils for a multi-axis configuration, in various embodiments. In various embodiments, additional circuitry may be used to provide additional gain or "response shaping" to match the telecoil response to the microphone, since the hearing aid will not be aware that it is a coil. However, such matching is not required as the telecoil is not built in to the hearing device.

Figure 4:
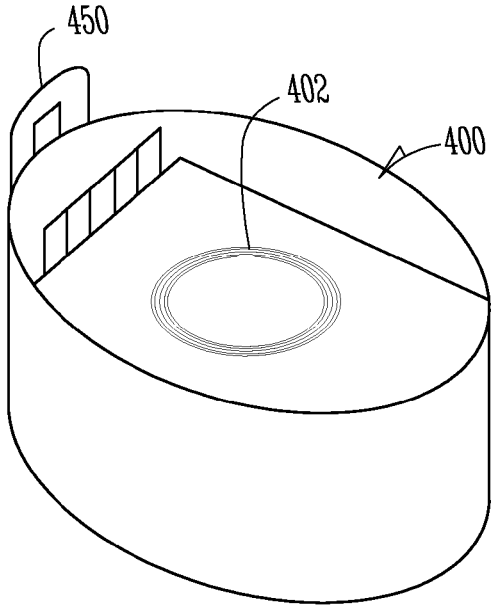
FIG. 4 illustrates a perspective view of a detachable DAI accessory for communication with a hearing assistance device, the DAI accessory including a telecoil for loop systems, according to one embodiment of the present subject matter.

FIG. 4 illustrates a perspective view of a detachable DAI accessory for communication with a hearing assistance device, the DAI accessory including a telecoil for loop systems, according to one embodiment of the present subject matter. The detachable DAI accessory 400, such as the apparatus 202 or 302 of FIGS. 2-3, has a telecoil 402 and a DAI connector 450 configured to detachably connect to a DAI port of a hearing assistance device. The telecoil 402 is a Z-axis SMD coil oriented for loop systems, in various embodiments. Various embodiments use SMD coils for ease of assembly.

Figure 5:
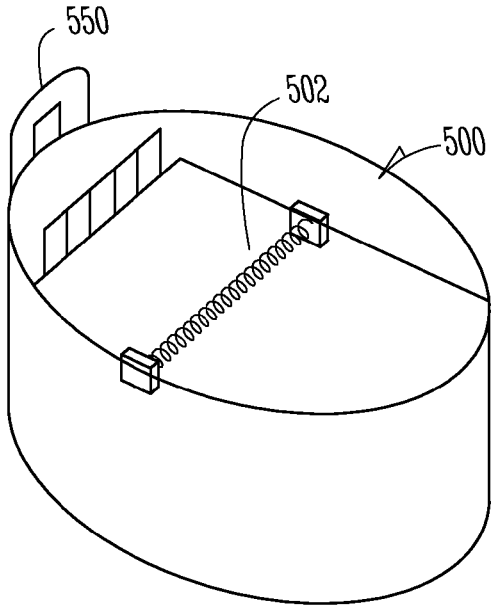
FIG. 5 illustrates a perspective view of a detachable DAI accessory for communication with a hearing assistance device, the DAI accessory including a telecoil for phone systems, according to one embodiment of the present subject matter.

FIG. 5 illustrates a perspective view of a detachable DAI accessory for communication with a hearing assistance device, the DAI accessory including a telecoil for phone systems, according to one embodiment of the present subject matter. The detachable DAI accessory 500, such as the apparatus 202 or 302 of FIGS. 2-3, has a telecoil 502 and a DAI connector 550 configured to detachably connect to a DAI port of a hearing assistance device. The telecoil 502 is a "telephone" orientation SMD coil oriented for phone systems, in various embodiments.

Thus, the present subject matter 1) provides smaller hearing aids that are more attractive to customers, 2) reduces the effort and risk associated with designing the associated hearing aid, and 3) reduces cost by not only using larger, less expensive telecoils, but also not putting a telecoil into every hearing aid if not every hearing aid user will desire a telecoil.

It is understood that variations in communications standards, protocols, and combinations of components may be employed without departing from the scope of the present subject matter. Hearing assistance devices typically include an enclosure or housing, a microphone, hearing assistance device electronics including processing electronics, and a speaker or receiver. Processing electronics include a controller or processor, such as a digital signal processor (DSP), in various embodiments. Other types of processors may be used without departing from the scope of this disclosure. It is understood that in various embodiments the microphone is optional. It is understood that in various embodiments the receiver is optional. Thus, the examples set forth herein are intended to be demonstrative and not a limiting or exhaustive depiction of variations.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. An apparatus for communication with a hearing assistance device, comprising:

a telecoil; and a direct audio input (DAI) connector electrically connected to the telecoil and configured to detachably attach to a DAI port of the hearing assistance device and to pass a signal from the telecoil to the hearing assistance device, wherein the telecoil includes an impedance configured to be sensed to indicate to the hearing assistance device that the apparatus is attached to the DAI port.

2. The apparatus of claim 1, further comprising an amplifier configured to amplify the signal.

3. The apparatus of claim 1, further comprising telecoil electronics.

4. The apparatus of claim 1, wherein the the input/output line includes a general purpose input/output (GPIO) pin of the processor of the hearing assistance device.

5. The apparatus of claim 1, wherein the telecoil is adapted for loop systems.

6. The apparatus of claim 1, wherein the telecoil is adapted for phone systems.

7. The apparatus of claim 1, wherein the telecoil includes multiple coils.

8. The apparatus of claim 7, wherein the multiple coils include coils with different sizes.

9. The apparatus of claim 7, wherein the multiple coils include coils with different orientations.

10. The apparatus of claim 1, wherein the telecoil includes surface mount coils.

11. The apparatus of claim 1, further comprising a housing, wherein the telecoil is housed within the housing and the DAI connector is included along a surface of the housing.

12. The apparatus of claim 11, wherein the housing includes a boot.

13. The apparatus of claim 12, wherein the boot is configured to fit over a portion of a housing of the hearing assistance device.

14. The apparatus of claim 1, wherein the hearing assistance device includes a hearing aid.

15. The apparatus of claim 14, wherein the hearing aid includes a behind-the-ear (BTE) hearing aid.

16. A method of operating a hearing assistance device, comprising:

detecting a telecoil signal received at a direct audio input (DAI) port of the hearing assistance device, the telecoil signal from a telecoil housed in an apparatus having a DAI connector configured to detachably attach to the DAI port of the hearing assistance device, wherein the telecoil includes an impedance configured to be sensed indicate to the hearing assistance device that the apparatus is attached to the DAI port.

17. The method of claim 16, wherein detecting a telecoil signal includes detecting an active telecoil signal.

18. The method of claim 16, wherein detecting a telecoil signal includes detecting a passive telecoil signal.

19. The method of claim 16, wherein detecting a telecoil signal includes sensing a low signal at the input/output line of the processor of the hearing assistance device.

20. The method of claim 19, wherein sensing a low signal at the input/output line of the processor includes sensing a low signal at a GPIO pin of a digital signal processor (DSP).

* * * * *

UNITED STATES PATENT AND TRADEMARK OFFICE

CERTIFICATE OF CORRECTION

PATENT NO. : 8,855,348 B2
APPLICATION NO. : 13/568637
DATED : October 7, 2014
INVENTOR(S) : Andrew Joseph Johnson It is certified that error appears in the above-identified patent and that said Letters Patent is hereby corrected as shown below:

In the Claims

In column 5, line 33, in Claim 1, after "sensed", insert --by the DAI post of the hearing assistance device--, therefor In column 5, line 34, in Claim 1, after "port", insert --,
wherein at least a portion of the DAI connector is configured to connect with an input/output line of a processor of the hearing assistance device--, therefor In column 5, line 39, in Claim 4, before "input/output", delete "the", therefor In column 6, line 31, in Claim 16, before "indicate", insert --by the DAI of the hearing assistance device to--, therefor In column 6, line 32, in Claim 16, after "port", insert --¶wherein at least a portion of the DAI connector is configured to connect with an input/output line of a processor of the hearing--, therefor Signed and Sealed this
Second Day of February, 2016

Michelle K. Lee

Michelle K. Lee
*Director of the United States Patent and Trademark Office*